US008862017B2

(12) United States Patent
Rodriguez et al.

(10) Patent No.: US 8,862,017 B2
(45) Date of Patent: Oct. 14, 2014

(54) USE OF AN ACOUSTIC CAVITY TO REDUCE ACOUSTIC NOISE FROM A CENTRIFUGAL BLOWER

(75) Inventors: Jorge Rodriguez, Webster, NY (US); Glenn Batchelor, Faiport, NY (US); Francisco Zirilli, Penfield, NY (US); Ali Dergham, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 154 days.

(21) Appl. No.: 13/357,966

(22) Filed: Jan. 25, 2012

(65) Prior Publication Data

US 2013/0188984 A1 Jul. 25, 2013

(51) Int. Cl.
*G03G 21/20* (2006.01)
*G03G 15/20* (2006.01)

(52) U.S. Cl.
CPC ..... *G03G 21/20* (2013.01); *G03G 15/2003* (2013.01)
USPC ..... 399/92; 399/94; 399/97

(58) Field of Classification Search
CPC ..... G03G 21/20; G03G 2221/1645
USPC ..... 399/92, 94, 97, 320
See application file for complete search history.

(56) References Cited

U.S. PATENT DOCUMENTS

| | | | | |
|---|---|---|---|---|
| 2,688,371 | A | 9/1954 | Sforza Del Pesaro | |
| 2,764,250 | A * | 9/1956 | Jeffords | 181/246 |
| 4,626,048 | A * | 12/1986 | Goodlander | 312/223.3 |
| 5,152,366 | A * | 10/1992 | Reitz | 181/249 |
| 5,536,140 | A | 7/1996 | Wagner et al. | |
| 6,039,532 | A * | 3/2000 | McConnell | 415/119 |
| 6,162,016 | A * | 12/2000 | Humbad | 415/204 |
| 6,259,871 | B1 * | 7/2001 | Rider et al. | 399/92 |
| 6,280,317 | B1 * | 8/2001 | Przilas et al. | 454/184 |
| 6,463,230 | B1 * | 10/2002 | Wargo | 399/92 |
| 6,565,171 | B2 | 5/2003 | Miquel et al. | |
| 6,771,916 | B2 * | 8/2004 | Hoffman et al. | 399/92 |
| 6,957,026 | B2 * | 10/2005 | Dergham et al. | 399/92 |
| 7,031,633 | B2 * | 4/2006 | Regan et al. | 399/94 |
| 7,266,860 | B2 | 9/2007 | Tate et al. | |
| 7,315,721 | B2 * | 1/2008 | Kitayama | 399/320 |
| 7,443,670 | B2 * | 10/2008 | Nishi et al. | 361/695 |
| 7,556,031 | B2 * | 7/2009 | Russell | 123/590 |
| 7,603,050 | B2 * | 10/2009 | Kim | 399/92 |
| 7,735,603 | B2 * | 6/2010 | Roberts | 181/230 |
| 7,780,408 | B2 * | 8/2010 | Lazzarato et al. | 415/211.2 |
| 7,883,312 | B2 * | 2/2011 | Eguchi et al. | 415/119 |
| 7,957,657 | B2 | 6/2011 | Zirilli et al. | |
| 8,116,653 | B2 * | 2/2012 | Kondo et al. | 399/92 |

(Continued)

OTHER PUBLICATIONS

U.S. Appl. No. 13/295,860, filed Nov. 14, 2011, Rodriguez et al.

*Primary Examiner* — Clayton E Laballe
*Assistant Examiner* — Kevin Butler
(74) *Attorney, Agent, or Firm* — Kevin Soules; Kermit D. Lopez; Luis M. Ortiz

(57) ABSTRACT

An acoustic cavity conditions the air flowing from a blower to reduce noise in the airflow. The air flowing directly out of the blower exhibits pulses produced by each impeller blade or fan blade. The airflow noise is thereby induced at certain frequencies. Printing operations inside a printer can also occur at specific frequencies. Introducing the airflow directly into certain areas of a printer can result in the noise frequencies and printing frequencies to combine and produce noticeable printing artifacts. An acoustic cavity tuned to dampen the airflow noise can condition the airflow and eradicate the printing artifacts.

20 Claims, 4 Drawing Sheets

(56) References Cited

U.S. PATENT DOCUMENTS

| | | | | |
|---|---|---|---|---|
| 8,151,931 | B2 * | 4/2012 | Eaton et al. | 181/224 |
| 8,231,331 | B2 * | 7/2012 | Wu | 415/119 |
| 8,434,589 | B1 * | 5/2013 | Rodriguez et al. | 181/225 |
| 2003/0091363 | A1 * | 5/2003 | Hoffman et al. | 399/92 |
| 2005/0113015 | A1 * | 5/2005 | Crippen et al. | 454/184 |
| 2006/0072933 | A1 * | 4/2006 | Miyamoto et al. | 399/92 |
| 2007/0065170 | A1 * | 3/2007 | Kimura | 399/92 |
| 2008/0053749 | A1 * | 3/2008 | Utsunomiya | 181/286 |
| 2008/0219693 | A1 * | 9/2008 | Kondo et al. | 399/92 |
| 2009/0090530 | A1 * | 4/2009 | Roberts et al. | 173/219 |
| 2009/0294211 | A1 * | 12/2009 | Roberts | 181/230 |
| 2011/0232992 | A1 * | 9/2011 | Utsunomiya | 181/225 |
| 2013/0188984 | A1 * | 7/2013 | Rodriguez et al. | 399/92 |

* cited by examiner

USE OF AN ACOUSTIC CAVITY TO REDUCE ACOUSTIC NOISE FROM A CENTRIFUGAL BLOWER

Embodiments are related to printing equipment, copy machines, Xerographic machines, Xerography, fans, and ducts.

BACKGROUND

Air is often blown into rooms, buildings, machines, and machine cavities to provide cooling. The airflow can introduce noise, such as acoustic noise, vibration, or uneven cooling. The noise usually goes unnoticed or is otherwise tolerated. However, there are situations wherein such noise results in problems that noticeably reduce the quality. One such situation is the airflow into certain models of printing machines, copy machines, and Xerographic equipment. Systems and methods for minimizing the impact of noise resulting from air flowing into copy machines are needed.

BRIEF SUMMARY

Aspects of the embodiments address limitations and flaws in the prior art by conditioning the airflow such that it does not noticeably impact printing and duplication processes.

In the interests of brevity, the term "printer" encompasses those machines used for printing and/or copying. Most printers are more sensitive to noise at some frequencies than at other frequencies. When noise is introduced into the system, particularly at those sensitive frequencies, print quality suffers. As with most machines, various printing operations occur at certain rates and thereby at certain frequencies. Noise at or near those frequencies or at multiples of those frequencies can result in noticeable "beat frequencies" that appear in the final product. For example, a 292 Hz banding problem has been observed in the output of a printer model. 292 Hz at first seems arbitrary, but the problem is very real when the printer or print quality is particularly sensitive to noise at that frequency.

On investigation, the noise source in the current example was found to be a centrifugal air blower spinning a 6 blade impeller at 2920 RPM. Each fan blade produces a slight pulse in the otherwise steady airflow such that the pulses occur at 292 Hz. The 292 Hz pulses were transmitted to a Xerographic chamber via the air supply hoses and ducts where they interacted with other printing operations to produce noticeable banding. Supply chain logistics indicated that changing the blower design was non trivial. Furthermore, a different blower would have introduced noise at other frequencies with possible problems that were yet to be diagnosed.

It is therefore an aspect of the embodiments to provide an acoustic cavity that conditions the airflow produced by the blower. Acoustic cavities can be designed to exhibit specific properties. In the current embodiments, the acoustic chamber is designed to dampen the pulses in the airflow at the frequency produced by the blower. The conditioned airflow then flows through a duct into a chamber of the printer to thereby produce printings that are not degraded by the airflow noise produced by the blower.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION OF THE INVENTION

The particular values and configurations discussed in these non-limiting examples can be varied and are cited merely to illustrate embodiments and are not intended to limit the scope of the invention.

An acoustic cavity conditions the air flowing from a blower to reduce noise in the airflow. The air flowing directly out of the blower exhibits pulses produced by each impeller blade or fan blade. The airflow noise is thereby induced at certain frequencies. Printing operations inside a printer can also occur at specific frequencies. Introducing the airflow directly into certain areas of a printer can result in the noise frequencies and printing frequencies to combine and produce noticeable printing artifacts. An acoustic cavity tuned to dampen the airflow noise can condition the airflow and eradicate the printing artifacts.

Figure 1:
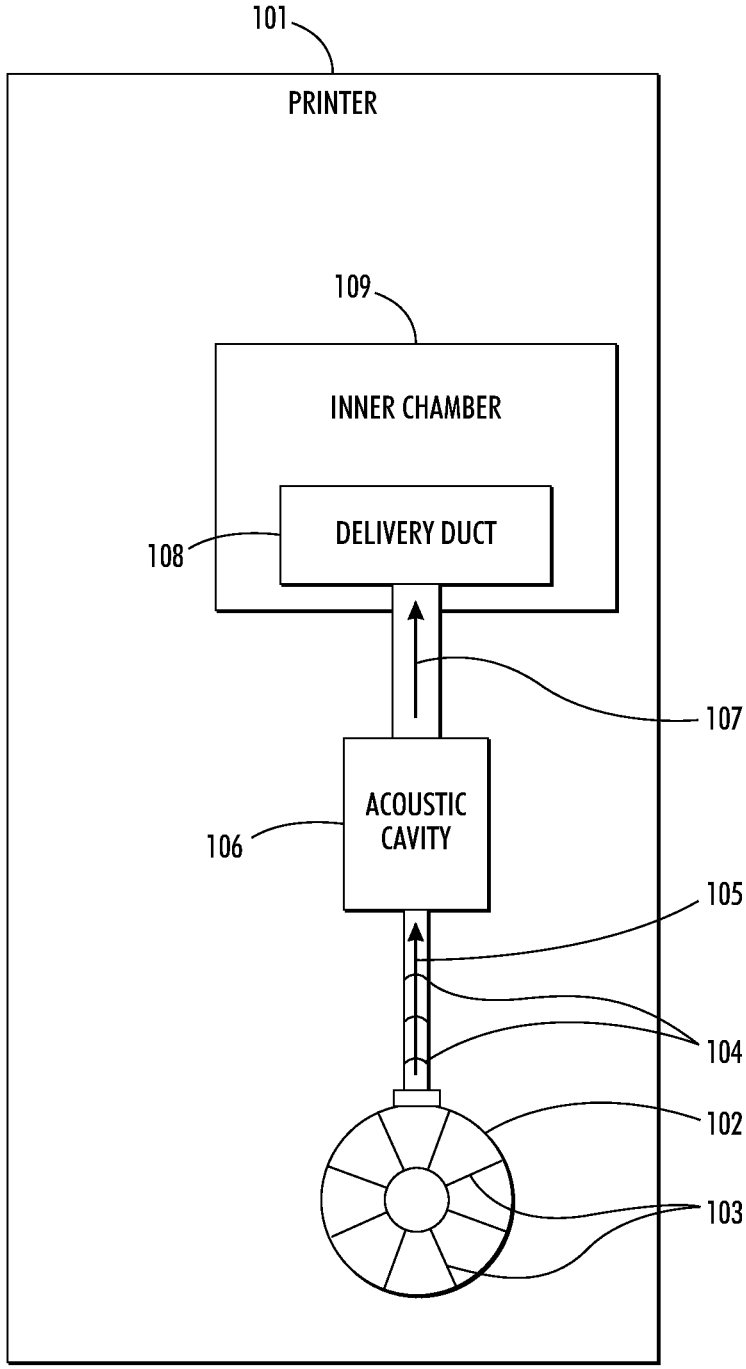
FIG. 1 illustrates an acoustic cavity conditioning the airflow from a blower in accordance with aspects of the embodiments.

FIG. 1 illustrates an acoustic cavity 106 conditioning the airflow 105 from a blower 102 in accordance with aspects of the embodiments. A blower 102 can be a centrifugal blower having numerous blades 103 that are spun by a motor. Air flows into the blower and the spinning blades push it through an output port. The airflow 105 typically exhibits pulses 104 corresponding to the passage of each blade 103 past the output port. For example, the illustrated impeller has 8 blades. If spun at 360 RPM (rotations per minute), the pulses 104 occur at 48 Hz (pulses per second). In many cases, the airflow 105 is a smooth flow punctuated by pulses 104.

The airflow 105 passes into an acoustic cavity 106 that filters out the pulses 104 to thereby produce a conditioned airflow 107 that is fed by a delivery duct 108 into an inner chamber 109 of a printer 101.

An acoustic cavity can be specifically designed to filter the pulses out of air flowing from a known blower design being operated at a known rate. The air flowing from the blower can be measured to determine its flow rate, pulse frequency, and pulse amplitude. Alternatively, the air flowing from the blower can be calculated or modeled. In many cases, the manufacturer can provide air flow data. The acoustic chamber and the air flowing through it can be modeled by a variety of modeling software packages using techniques such as computational fluid dynamics.

Figure 2:
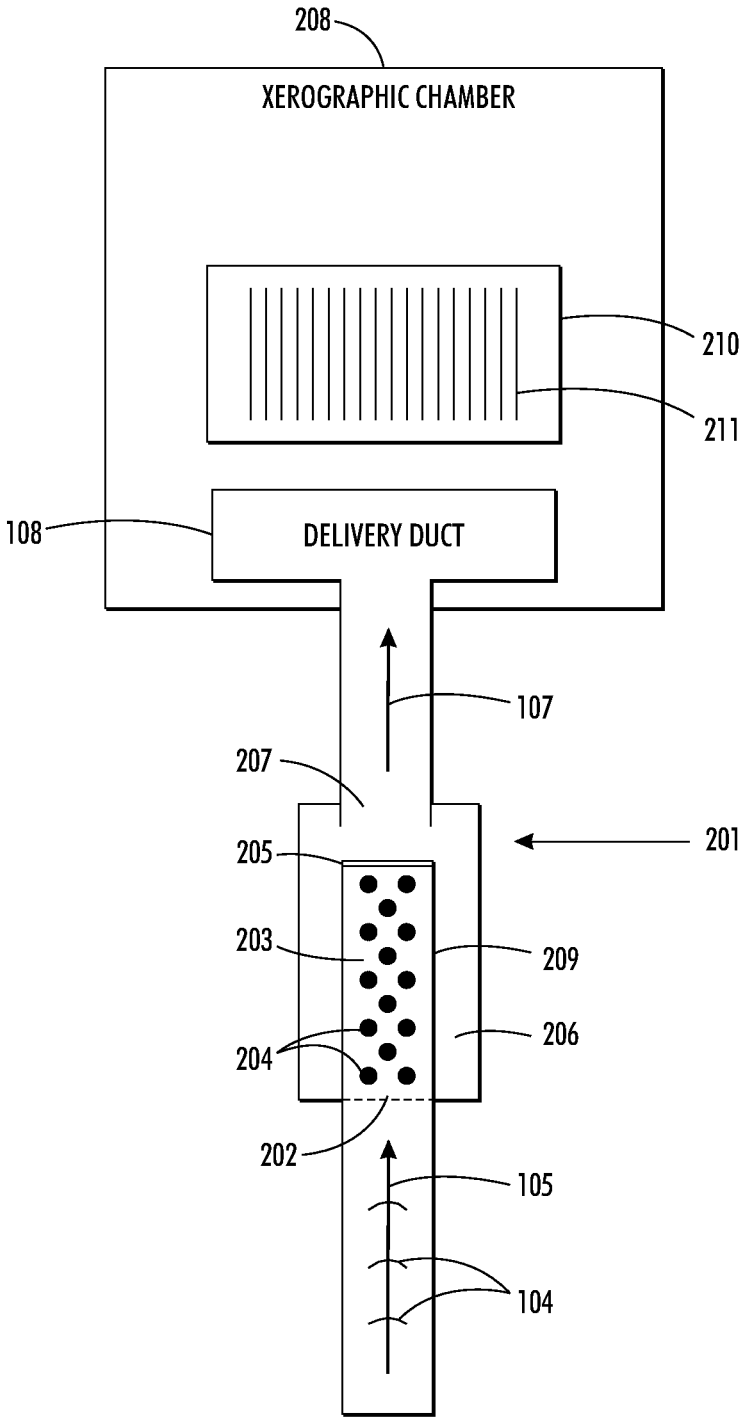
FIG. 2 illustrates a muffler conditioning the airflow before it is ducted into a Xerographic cavity in accordance with aspects of the embodiments.

FIG. 2 illustrates a muffler 201 conditioning the airflow 105 before it is ducted into a Xerographic chamber 208 in accordance with aspects of the embodiments. A muffler can have an inner chamber 203 and an outer chamber 206 separated by a chamber wall 209. Perforations or holes 204 in the chamber wall 209 allow air to flow from one chamber to another. FIG. 2 illustrates the airflow 105 passing through a chamber input 202, into the inner chamber 203, through holes 204, into the outer chamber 206, and out a chamber output 207. The end of the inner chamber 203 is here illustrated as closed by cap 205 although inner chambers are not always capped. As discussed above, the muffler 201 can be designed specifically for filtering pulses 104 from the airflow 105. The spacing and patterning of the holes 204 is part of the design.

The conditioned airflow 107 from the muffler 201 can then pass to and through a delivery duct 108 and into a Xerographic chamber 208. The conditioned airflow 107 can cool the Xerographic chamber 208 and can speed the setting of toner 211 printed onto media 210 such as paper.

Figure 3:
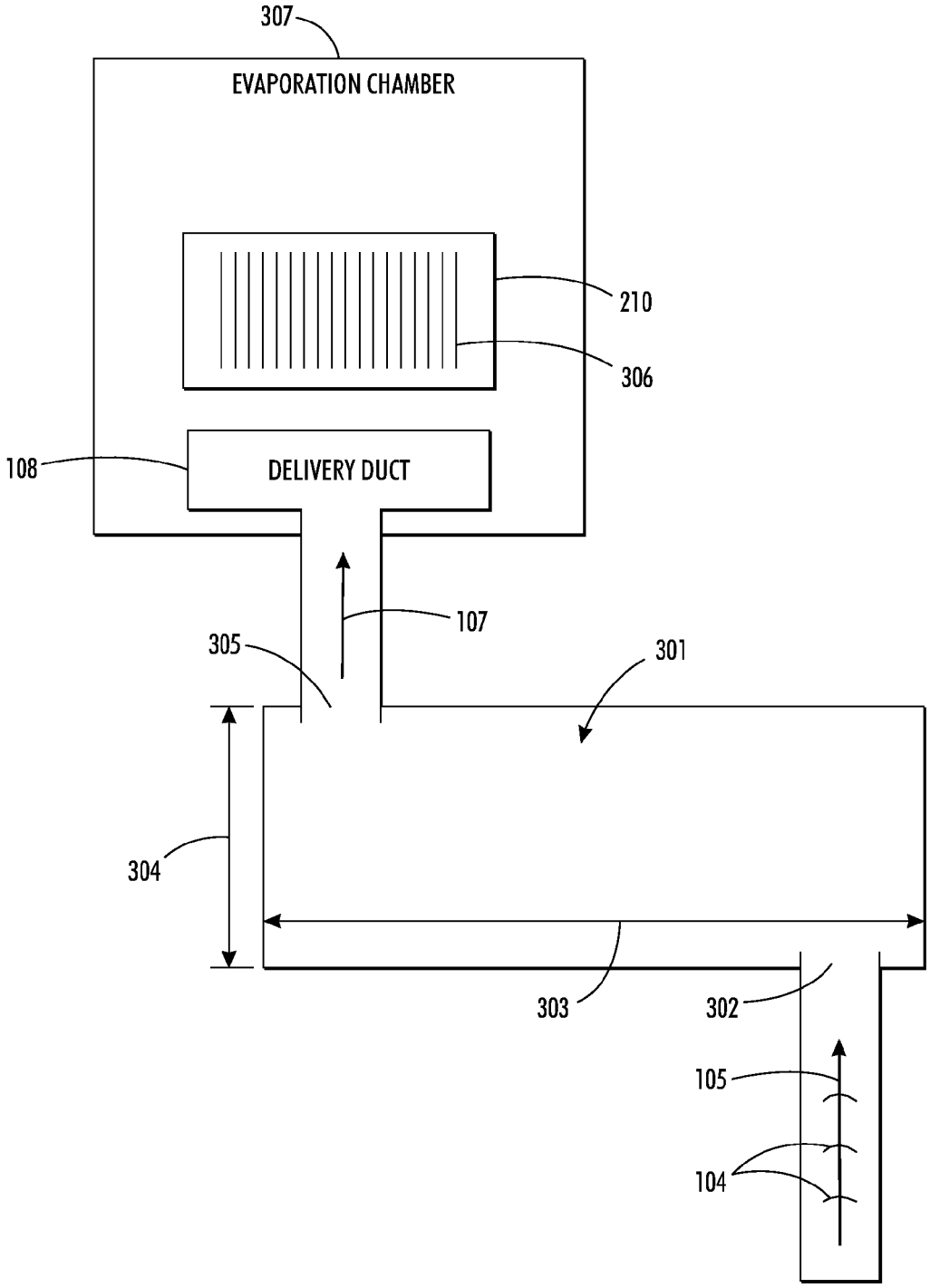
FIG. 3 illustrates an acoustic cavity conditioning the airflow before it is ducted into an evaporation chamber in accordance with aspects of the embodiments.

FIG. 3 illustrates an acoustic cavity 301 conditioning the airflow 105 before it is ducted into an evaporation chamber 307 in accordance with aspects of the embodiments. The acoustic cavity 301 of FIG. 3 has only a single chamber and the filtering action is a product of the chamber geometry and positioning of the chamber input 302 and chamber output 305. The chamber geometry can be specified by the chamber's height 304, width 303, and depth (not shown). The acoustic chamber illustrated in FIG. 3 is rectilinear with all corners being square. In practice, an acoustic chamber does not need to be rectilinear but can have a far more complex geometry with non-square corners, curved walls, and other features. An aspect of certain acoustic chambers is interior baffles. Interior baffles create forms and structures within the acoustic chamber around which the air must flow. As discussed above, an acoustic chamber having a known chamber geometry and perhaps one or more internal baffles can be modeled such that it filters the pulses 104 from the input airflow 105.

The conditioned airflow can then be ducted into the evaporation chamber 307 where it can provide cooling and can help set or dry ink 306 printed onto media 210.

Figure 4:
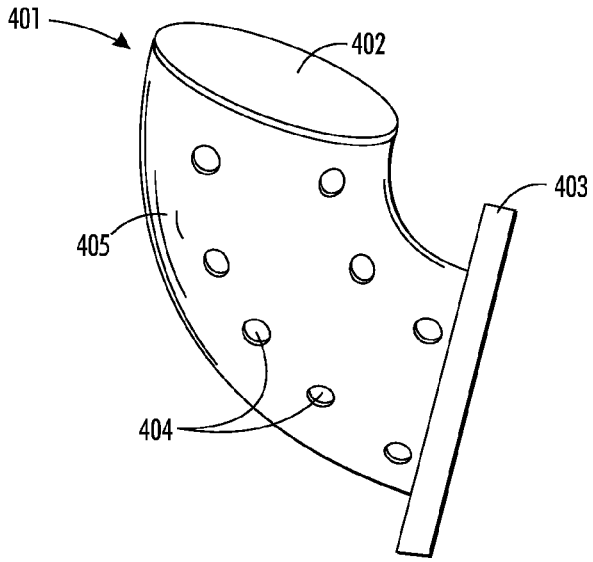
FIG. 4 illustrates a muffler inner chamber and chamber wall designed for a specific application in accordance with aspects of the embodiments.

FIG. 4 illustrates a muffler inner chamber 401 and chamber wall 405 designed for a specific application in accordance with aspects of the embodiments. The inner chamber is capped 402 and has a flange 403. The flange 403 provides a connection point for the 48 mm blower airflow input and also a connection point for the outside wall of the muffler. The geometry of the muffler, of the inner chamber 401, and of the holes 404, 26 in this case, was shown through modeling to be highly effective for the 292 Hz pulse problem mentioned above.

Figure 5:
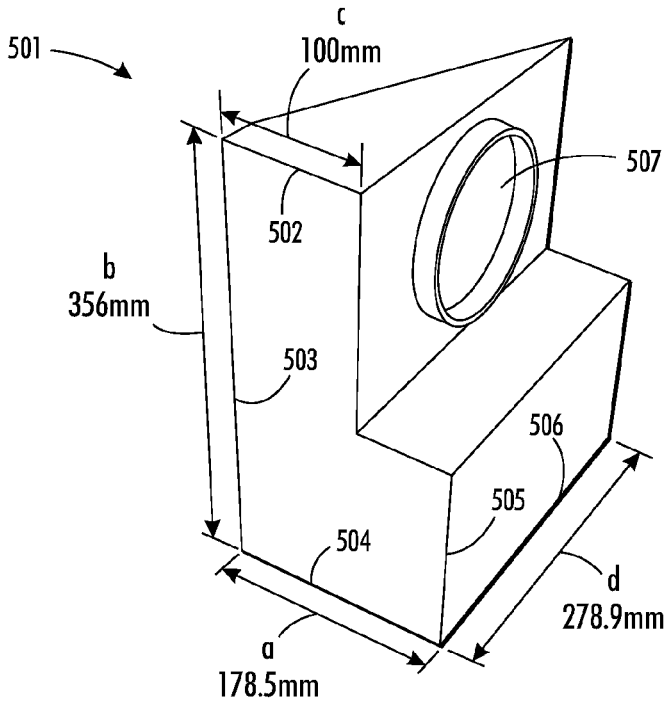
FIG. 5 illustrates an acoustic chamber designed for a specific application in accordance with aspects of the embodiments.

FIG. 5 illustrates an acoustic chamber 501 designed for a specific application in accordance with aspects of the embodiments. The acoustic chamber geometry is defined by a set of parameters. Parameter a 504 is 178.5 mm, parameter b 503 is 356 mm, parameter c 502 is 100 mm, and parameter d 506 is 278.9 mm. The airflow input is through a 46 mm hole (not shown) and the conditioned airflow exits through a 72 mm hole 507. This acoustic chamber was also shown through modeling to be highly effective for the 292 Hz pulse problem mentioned above.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An air delivery system for a copy machine comprising:

an air blowing subsystem delivering an airflow wherein the air blowing subsystem comprises a plurality of rotating blades that create pulses in the airflow wherein the pulses occur at a delivery frequency;

an acoustic cavity that is tuned to dampen the pulses at the delivery frequency and transfer a conditioned airflow to a delivery duct; and said delivery duct providing the conditioned airflow to a Xerographic chamber of the copy machine to thereby provide cooling to set toner deposited on a substrate.

2. The system of claim 1 wherein the acoustic cavity is a muffler comprising an inner chamber, an outer chamber, a wall between the inner chamber and the outer chamber, and a plurality of holes in the wall wherein the holes are arranged to dampen the cyclic variation at the delivery frequency.

3. The system of claim 1 wherein the acoustic cavity comprises a single chamber, an inlet, an outlet, and a chamber geometry wherein the chamber geometry is arranged to absorb and reduce the cyclical variation at the delivery frequency.

4. An air delivery system for a copy machine comprising:

an air blowing subsystem delivering an airflow wherein the airflow has a cyclical variation that varies at a delivery frequency;

an acoustic cavity that is tuned to dampen the cyclical variation of the airflow at the delivery frequency to thereby produce a conditioned airflow from the airflow; and a delivery duct providing the conditioned airflow to an interior cavity of the copy machine.

5. The system of claim 4 wherein the acoustic cavity is a muffler comprising an inner chamber, an outer chamber, a wall between the inner chamber and the outer chamber, and a plurality of holes in the wall wherein the holes are arranged to dampen the cyclic variation at the delivery frequency.

6. The system of claim 5 wherein the air blowing subsystem comprises a centrifugal air blower comprising a 6 rotating blade impeller spinning at 2920 revolutions per minute wherein the rotating blades create pulses in the airflow at the delivery frequency.

7. The system of claim 6 wherein the interior cavity is a Xerographic chamber.

8. The system of claim 7 wherein the conditioned airflow is directed to provide cooling to thereby set toner deposited onto a substrate.

9. The system of claim 5 wherein the interior cavity is a Xerographic chamber.

10. The system of claim 5 wherein the interior cavity is an evaporation chamber.

11. The system of claim 4 wherein the acoustic cavity comprises a single chamber, an inlet, an outlet, and a chamber geometry wherein the chamber geometry is arranged to absorb and reduce the cyclical variation at the delivery frequency.

12. The system of claim 11 wherein the air blowing subsystem comprises a centrifugal air blower comprising a 6 rotating blade impeller spinning at 2920 revolutions per minute wherein the rotating blades create pulses in the airflow at the delivery frequency.

13. The system of claim 12 wherein the interior cavity is a Xerographic chamber.

14. The system of claim 13 wherein the conditioned airflow is directed to provide cooling to thereby set toner deposited onto a substrate.

15. The system of claim 11 wherein the interior cavity is a Xerographic chamber.

16. The system of claim 11 wherein the interior cavity is an evaporation chamber.

17. The system of claim 4 wherein the interior cavity is a Xerographic chamber.

18. An air delivery system for a copy machine comprising:

an air blowing subsystem delivering an airflow and comprising a means for cyclically varying the airflow at a delivery frequency;

a means for conditioning the airflow by tuning an acoustic cavity to dampen the cyclical variation of the airflow at the delivery frequency to thereby produce a conditioned airflow; and a means for delivering the conditioned airflow to an internal cavity of the copy machine.

19. The system of claim 18 wherein the means for conditioning the airflow is a muffler comprising an inner chamber, an outer chamber, a wall between the inner chamber and the outer chamber, and a plurality of holes in the wall wherein said plurality of holes is arranged to dampen the cyclic variation at the delivery frequency.

20. The system of claim 18 wherein the means for conditioning the airflow is a single chamber and comprises an inlet, an outlet, and a chamber geometry wherein the chamber geometry is arranged to absorb and reduce the cyclical variation at the delivery frequency.

* * * * *